US006948629B1

(12) United States Patent
McClay

(10) Patent No.: US 6,948,629 B1
(45) Date of Patent: Sep. 27, 2005

(54) REMOTE OPERATED ACCESSORY RACK

(76) Inventor: Grant McClay, 870 Avenue A, Redondo Beach, CA (US) 90277

( * ) Notice: Subject to any disclaimer, the term of this patent is extended or adjusted under 35 U.S.C. 154(b) by 130 days.

(21) Appl. No.: 10/642,323

(22) Filed: Aug. 15, 2003

Related U.S. Application Data

(60) Provisional application No. 60/404,742, filed on Aug. 21, 2002.

(51) Int. Cl.[7] ..... A47B 43/00

(52) U.S. Cl. ..... 211/196; 211/1.51; 211/175; 211/197

(58) Field of Search ..... 211/196, 175, 195, 211/1.51, 2, 1.57; 108/20; 248/158, 422, 248/406.1, 406.2

(56) References Cited

U.S. PATENT DOCUMENTS 2,769,248 A * 11/1956 Ashworth ..... 34/665
5,183,162 A * 2/1993 Ritzenthaler ..... 211/1.57
5,232,105 A * 8/1993 Gregg ..... 211/113
5,845,788 A * 12/1998 Robolin ..... 211/17
5,848,710 A * 12/1998 Pomper ..... 211/85.2
6,464,088 B1 * 10/2002 Caplan et al. ..... 211/40
6,672,463 B2 * 1/2004 Dashefsky ..... 211/13.1
6,698,854 B1 * 3/2004 Knox et al. ..... 312/307
6,726,033 B2 * 4/2004 Sparkowski et al. ..... 211/85.3

* cited by examiner

*Primary Examiner*—Jennifer E. Novosad

(57) ABSTRACT

A rack includes a stationary container, that includes a movable member positioned within the container by remote operation of a motor. The motor is either carried as part of the movable member or is in the container with fittings inter-connecting a drive shaft of the fixed motor with the movable member. A remote actuator is employed for starting and stopping the motor so that the movable member is controllably deployed into and out of the container. Bearings are installed between the container and the movable member to provide movement of the movable member and pivoting rods are provided on the movable member for supporting articles intended to be stored, such rods being hooks, shelves, or internal compartments or the like. A heater may be installed for drying any wet or damp articles.

A device for coupling the motor to the movable member may be a lead screw mechanism and a pulley system interconnecting the movable member with the stationary or fixed container.

14 Claims, 4 Drawing Sheets

REMOTE OPERATED ACCESSORY RACK

This application claims the benefit of Provisional Application No. 60/404,742 filed Aug. 21, 2002.

BACKGROUND OF THE INVENTION

1. Field of the Invention

The present invention relates to the field of storage racks and accessory holders and more particularly to a novel storage rack which is remotely operated for moving a pedestal out of a housing so that access is available to items stored on the pedestal.

2. Brief Description of the Prior Art

In the past, it has been the conventional practice to provide a storage cabinet, clothes rack, horizontal towel racks, or the like for storing a variety of accessories or items such as beverage cans, optional clothing and/or towels. Preferably, such storage cabinets or racks are located in the vicinity of equipment or apparatus intended to be used such as cabinets or racks by a swimming pool, spa, hot tub or the like. Conventionally, such cabinets include doors which are closed and are manually opened when it is desired to withdraw an article from the cabinet, or, in the case of racks, the items, such as a towel, is exposed to the environment.

Problems and difficulties have been encountered when using such conventional storage cabinets or racks which stem largely from the fact that such storage means are remote from the pool or hot tub and, therefore, a person exiting such a pool or tub is wet and exposed to the environment while traveling to the fixed cabinet or rack in order to obtain an item, such as a towel. In other instances, the storage item may be beverage containers, swim floats, swim goggles, sun glasses or the like.

Therefore, a long standing need has existed to provide a remotely operated accessory storage holder or rack having a first enclosed position and a second exposed position, wherein a motorized unit is employed to deploy or activate the unit between the two positions. The holder or rack unit should include trays, hooks, or other means for providing support and storage for the items and the holder or rack should be suitable for mounting within a support structure or on the outside of the support structure. In some instances, heating means may be provided for drying damp or wet stored articles.

SUMMARY OF THE INVENTION

Accordingly, the above problems and difficulties are avoided by the present invention which provides a novel holder or rack which includes a stationary or fixed container, such as a tube, and which includes a movable member readily positioned within the container by remote operation of a motor means. The motor means may either be carried as part of the movable member or may be in a stationary or fixed position on the container with means inter-connecting the drive shaft of the fixed motor with the movable member. A remote actuator is employed for starting and stopping the motor, whether it is fixed or stationary, so that the movable member is controllably deployed into and out of the container. Bearing means are installed between the container and the movable member to provide movement of the movable member and means are provided on the movable member for supporting articles intended to be stored, such as hooks, shelves, internal compartments or the like. A heater may be installed for drying any wet or damp articles.

In one form of the advancement means, coupling the motor to the movable member may be a lead screw mechanism and a pulley system interconnecting the movable member with the stationary or fixed container.

Therefore, it is among the primary objects of the present invention to provide a novel storage rack or container that is remotely operated by a transmitting unit so that a movable member carrying the stored items can be moved in and out of a stationary support container.

Yet another object of the present invention is to provide a remotely operated storage member containing such items as towels, beverage containers, or the like, that is movable in and out of a fixed or stationary supporting container that may be carried internally or externally on a supporting structure.

Still another object of the present invention is to provide a remote transmitting unit for operating a motor-controlled storage holder or rack that employs an over-current limiting device which prevents circuit overload conditions.

Yet another object of the present invention is to provide a remotely operated rack or holder member which is arranged in telescoping arrangement with a stationary container or tube that may be located in the ground, on or in a structure, such as a spa or hot tub, construction.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1A:
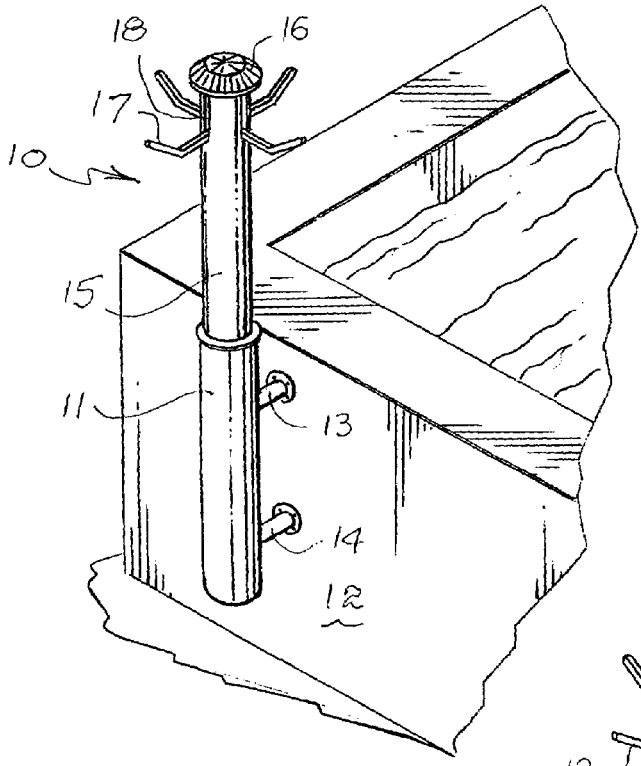
FIG. 1A is a perspective view, illustrating the remote operated accessory rack carried exteriorly of a supporting structure.

Referring to FIG. 1A, the novel remote actuated accessory rack or holder is indicated in the general direction of arrow 10, which includes a tubular housing 11 which is fixed externally to a supporting wall 12 by means of outwardly projecting supports 13 and 14 so that the rack or holder 10 is cantilevered outwardly from the side of the structure 12. A movable member 15 is arranged in sliding and telescoping arrangement with respect to the housing 11 and includes a top end for supporting a solar cell array 16 employed for charging internal batteries for a motor means. A motor means (not shown) is included in a fixed manner in the housing 11 or it can be included on the movable member 15 which will be described later.

The top end of the movable member 15 includes means for supporting articles to be stored or carried thereon. In the present illustration, a plurality of pivoting arms or hooks 17 are included and are arranged so that when the movable member 15 moves downwardly into the housing 11, the hooks will pivot into respective receiving slots so that the member 15 can be completely enclosed within the housing except for the solar array 16, which also serves as a limit stop. Such a slot or receiver for the pivoting hook is identified by numeral 18.

Figure 1B:
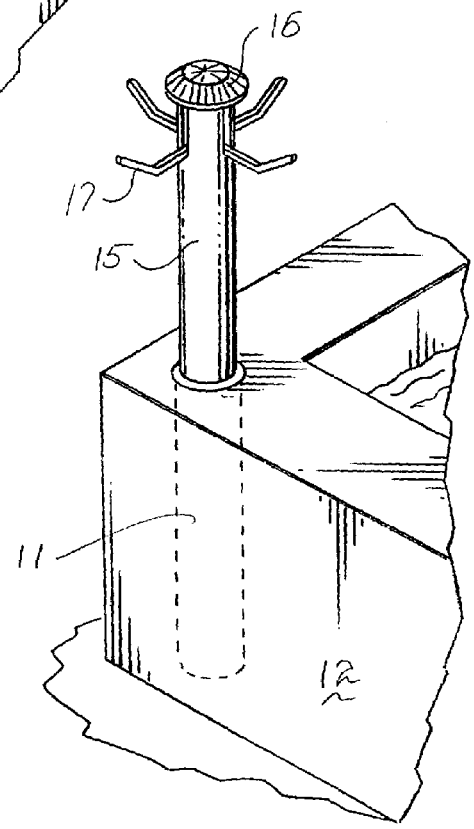
FIG. 1B is a view, similar to the view of FIG. 1A, illustrating the remote operated accessory rack carried internally of the supporting structure.

With respect to FIG. 1B, it is noted that the housing 11 is installed into the structure 12 so as to be hidden and will not interfere with passage of personal equipment or the like. The movable member 15 is adapted to reciprocate within the housing, as previously described, and article supporting pivoting hooks 17 remain the same as previously described.

It is to be understood that the article supporting arms or hooks may be used for holding towels, bathing accessories or the like. Also, a tray may be included in a cavity which may be incorporated into the movable member for storing beverage containers or the like.

Figure 2:
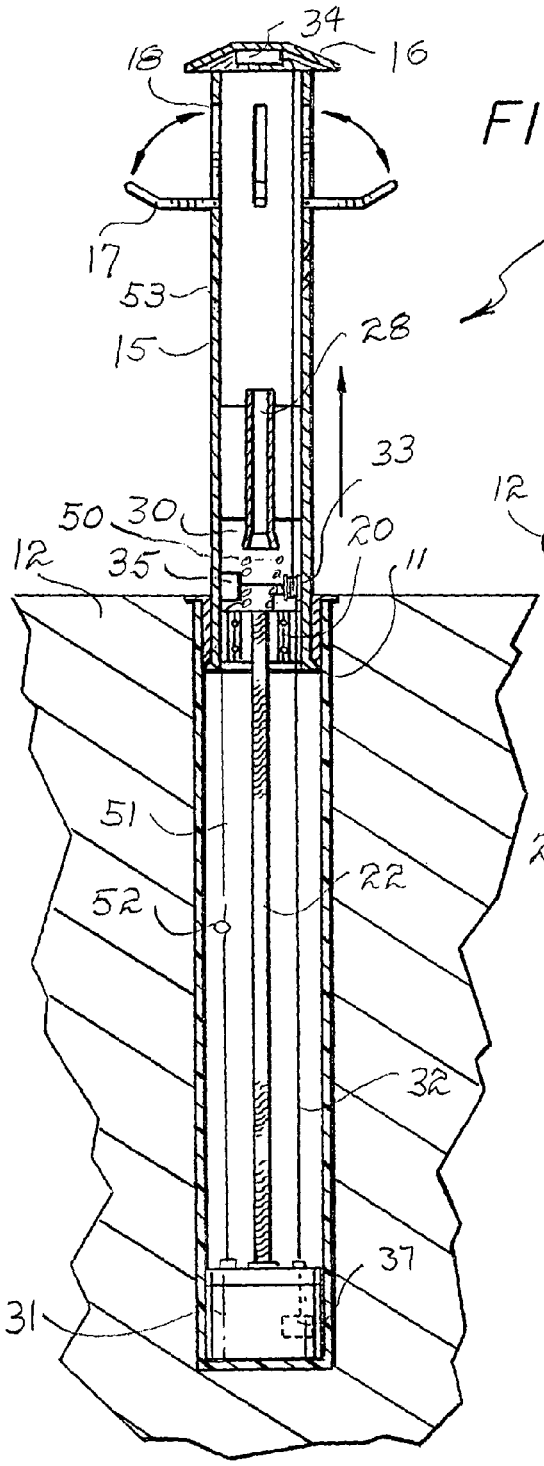
FIG. 2 is a longitudinal, cross-sectional view of the remote operated accessory rack previously illustrated.

Referring now in detail to FIG. 2, it can be seen that the movable member 15, which may take the form of a tube, is mounted within the bore of the housing 11 that may also take the form of a tube. The lower end of the movable member 15 includes a motor 20 having an inner drive armature 21 threadably engageable with a stationary lead screw 22, more thoroughly shown in FIG. 3. An outer motor housing 23 is secured to the inner wall surface of the bore of member 15. Therefore, it can be seen that as the drive armature 21 rotates, the member 15 will move along the length of the lead screw to elevate or retract the tube from the structure 12. A stainless steel stopper device 24 is disposed between the top of housing 11 and a Teflon collar 25. The collar 25 permits the member 15 to move smoothly in a rectilinear direction in response to rotation of the drive armature 21. Also, the stopper device 24 includes a flange 26 serving as a stop for the member 15 when the stop is engaged by a flange 27 outwardly projecting from the bottom of the member 15.

It can be seen that as the movable member 15 moves into the housing 11, the stationary lead screw 22 will pass through the interior of a guide 28. The guide 28 includes a flared lower portion 30 for aligning and permitting the end of the lead screw to enter the interior of the guide.

It can also be seen in FIG. 2 that a battery 31 is located at the bottom of housing 11 and is fixed thereto and does not move nor follow the movement of the member 15. Also, in order to charge the battery and to provide control for the movable member to prevent over-loading or unnecessary fatigue on the motor, a pulley circuit wiring system is provided having a lead, cable or cord 32 connected between the solar cell array 16 and the battery 31 via a spool 33.

Figure 3:
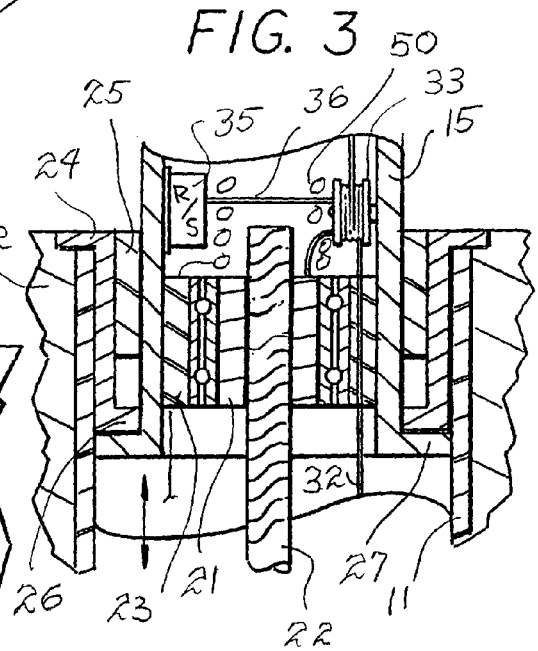
FIG. 3 is an enlarged, fragmentary sectional view of the motor means for operating the movable storage member, as shown in FIG. 2.

Referring now in detail to FIG. 3, it can be seen that the embodiments shown in FIGS. 2 and 3 further includes an electrical circuit for controlling the motor 20. The circuit includes the battery pack 31 arrangement, and a wiring cable 32 constitutes wiring which charges the battery from the solar array 16. The array is coupled to a battery charger if the user desires to use a land line for charging the battery, rather than the solar system, and such is indicated by numeral 34 adjacent the solar array. The circuit further includes a reversing switch and pressure switch, indicated by numeral 35, and this switch is coupled to the wiring cable 32 by lead 36. Therefore, it can be seen that the movable member 15 moves up and down along the length of the lead screw 22, under motor 20 control, and that reversing switch and pressure switch 35 is incorporated to control the movement of the member 15 so as to prevent over-load and to serve as directional control for advancing or retracting the member 15. The arms 17 may be gravity deployed once the member 15 has been raised away from the structure 12 and the hangers or arms 17 will be pivoted back into their storage slots or grooves when the arms are engaged with the stop device 24 and collar 25. The electrical circuit further includes switch 37 which stops the movement of the tube or member 15 by shutting off the motor in response to engagement of the flange 27 with the switch 37.

A heating coil 50 is included as an electrical resistance heating unit coupled to the battery, or hard wiring, via a cable 51. Tension is maintained on the cable by a negator spring device 52. Heat from the coil is exhausted or vented through a plurality of vents, such as vent 53.

Figure 4:
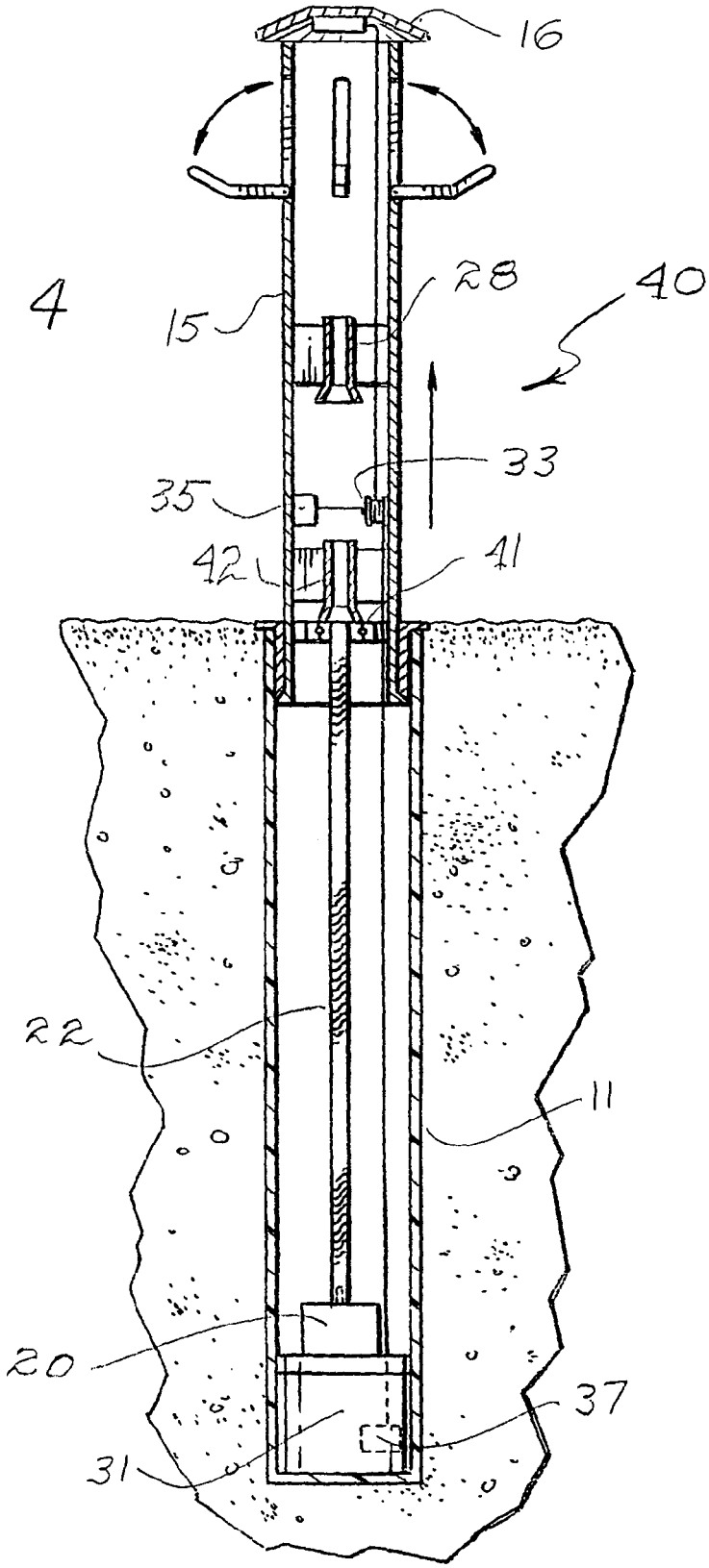
FIG. 4 is a longitudinal, sectional view of another embodiment of the present invention, wherein the power means is stationary.

Referring to FIG. 4, another embodiment of the invention is illustrated in the general direction of arrow 40 wherein the lead screw 22 is turned by a stationary motor 20 which is mounted adjacent to the battery 31 at the lower end of the housing 11. Coupled in threadable relationship with the threads on the lead screw 22 is the inner race of a bearing 41. The bearing is carried in fixed securement to the inner bore of the tube or member 15. An auxiliary guide 42 is included in addition to the guide 28 to accommodate insertion and passage of the lead screw as the member 15 moves up and down within the bore of housing 11. The same stop device and collar arrangement as described with respect to the embodiment 10 is also employed in the embodiment shown in FIG. 4. Therefore, it can be seen that the motor means for driving the lead screw is fixed so that the movable member 15 may be raised or retracted accordingly. The motor means may be either stationary as mounted at the bottom of housing 11 as in FIG. 4, or may be carried on the movable tube 15 as in FIG. 2.

Figure 5:
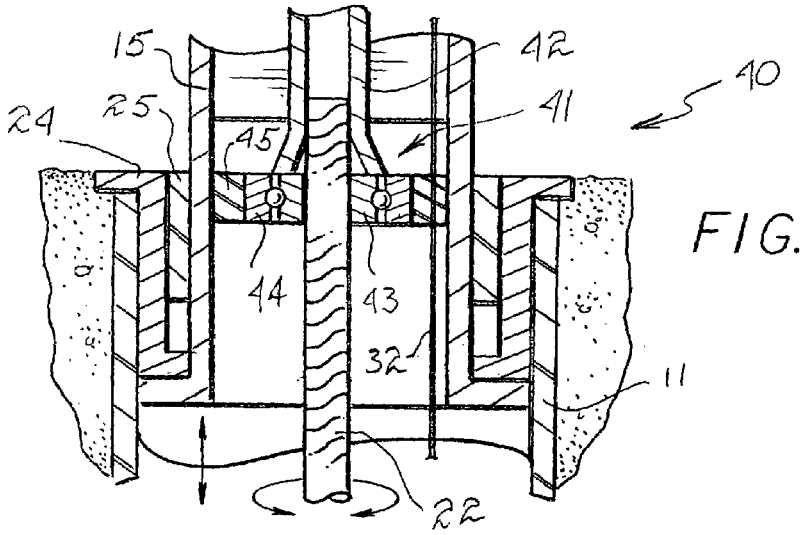
FIG. 5 is an enlarged perspective view of the power means shown in FIG. 4.

Referring now in detail to FIGS. 4 and 5, it can be seen that the housing 11 is buried in the ground, rather than onto a raised or elevated supporting structure, such as a spa or hot tub structure. Also, bearing 41 includes an inner race 43 which is in threadable engagement with the lead screw 22 and that the bearing further includes an outer race 44 carried on a case 45 that is fixed to the inside diameter of the bore or removable tube or member 15. Therefore, as the stationary motor 20, as shown in FIG. 4, draws the lead screw 22 in either a clockwise or counter clockwise direction, the movable member will proceed upwardly or downwardly in response thereto.

Figure 6:
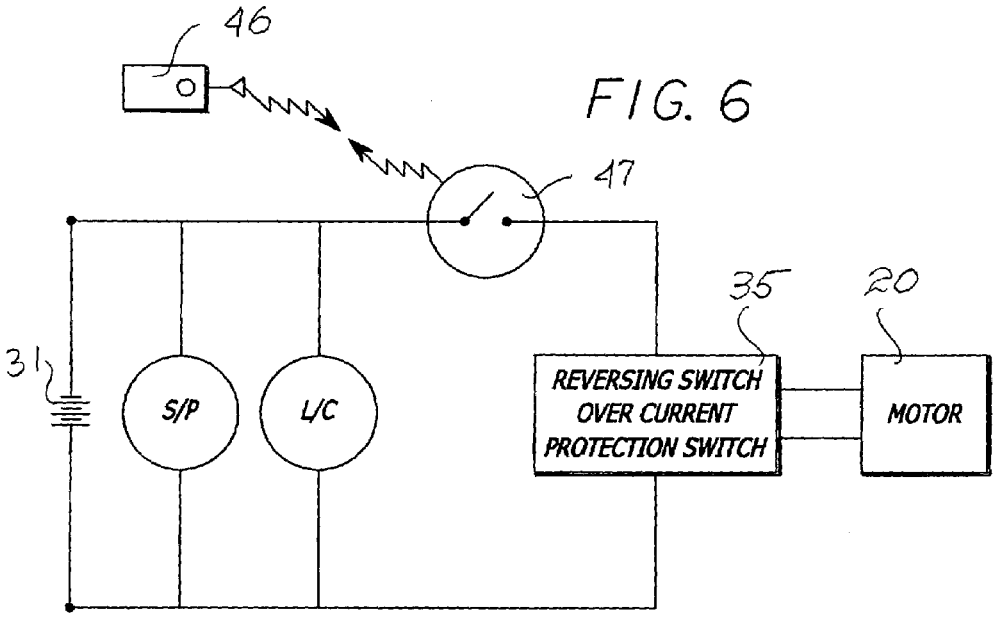
FIG. 6 is a block diagram illustrating the general circuit for operating the movable storage holder or rack employed by the present invention.

Referring to FIG. 6, it can be seen that the remote transmitter 46 can be push-button operated in order to have sensor 47 operating as a switch that completes the electrical circuit energizing the motor 20. A reverse polarity feature is included causing the motor to operate the movable member so as to make the member move up or down and the circuit includes means for starting and stopping the motor using a remote control switch, as previously described. Pressure of the motor on a contact switch causes the motor to over-load and then the switch 35 operates to reverse the action to releave the overload. Any interference or engagement with the movable tube or member 15 will cause the tube or member to stop. The over-current limiting device senses the current during over-load and will cause the reverse operation.

In view of the foregoing, it can be seen that the present inventive rack or holder may readily support a plurality of bathing items such as towels, swimsuits, or the like, and that trays or storage compartments can be put into the movable member 15 for supporting beverage cans, sunglasses or the like. The movable member 15 moves up and down in response to actuation of the motor 20 and such actuation is under remote control of a push-button transmitter 46 carried by the user. Upon raising to an elevated position, arms or hooks are deployed by gravity and can subsequently be used for a rack for holding swim towels or the like. Upon removal of such items, the movable member can be retracted and withdrawn into the housing 11 for storage purposes. The exposure of the solar cell 15 permits continual charging of the battery; however, a land line may also be employed for connecting to a charging unit.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A remote operated accessory rack comprising:

a stationary housing;

a movable member slidably carried on said stationary housing;

said movable member having opposite ends with a selected end having an outwardly deployable article supporting means;

motor means operably connected between said stationary housing and said movable member for advancing and retracting said movable member out of and into said stationary housing;

said deployable article supporting means are pivotal arms adapted to pivot into a storage position upon engagement with said stationary housing in response to retraction of said movable member;

a power source mounted in said stationary housing;

a solar cell array carried on said selected end of said movable member adjacent to said pivotal arms; and an extendable wiring circuit coupled between said power source and said solar cell array.

2. The rack defined in claim 1 including:

a resistance heater carried on said movable member; and vents provided in said movable member adjacent to said pivotal arms for conducting heat waves from said heater externally of said movable member.

3. The rack defined in claim 2 including:

a lead screw disposed between said stationary housing and said movable member; and said motor means operably connected to said lead screw for advancing and retracting said movable member out of and into said stationary housing.

4. The rack defined in claim 3 wherein:

said motor means is mounted in said stationary housing.

5. The rack defined in claim 2 including:

a cable coupled between said power source and said heater;

a resilient tension means attached to said cable responsive to movement of said movable member to extend and shorten the length of said cable as said movable member advances and retracts respective of said stationary member.

6. The rack defined in claim 5 wherein:

said power source is a battery fixedly mounted in said stationary housing.

7. The rack defined in claim 1 wherein:

said motor means is fixedly carried on said movable member.

8. A remote operated accessory rack comprising:

an elongated stationary housing;

a movable member slidably carried on said stationary housing for rectilinear movement along the length of said stationary housing;

said movable member having opposite ends with a selected end having outwardly deployable article supporting means;

motor means operably connected between said stationary housing and said movable member for advancing and retracting said movable member out of and into said stationary housing;

said deployable article supporting means are pivotal arms adapted to pivot into a storage position upon engagement with said stationary housing in response to retraction of said movable member and deployable outwardly from said movable member by gravitational force;

a power source mounted in said stationary housing connectable with said motor means;

a solar cell array carried on said selected end of said movable member adjacent to said pivotal arms;

an extendable wiring circuit coupled between said power source and said solar cell array and in parallel with said motor means;

a lead screw fixedly carried within said stationary housing; and said motor means carried on said movable member and in operable coupling with said lead screw for driving said movable member.

9. The rack defined in claim 8 including:

said motor means carried on said stationary housing operably coupled to said lead screw for turning said lead screw; and bearing means mounted on said movable member connected to said lead screw for driving said movable member between an advanced position out of said stationary housing and a retracted position within said stationary member.

10. The rack defined in claim 8 including:

a sealing arrangement mounted on said stationary housing slidably mounting said movable member.

11. The rack defined in claim 10 wherein:

said wiring circuit includes a reversing switch operable in response to said movable member for reverse directional movement.

12. The rack defined in claim 10 including:

a guide mounted on said movable member having a central passageway for insertably receiving and guiding said lead screw therethrough.

13. A remote operated accessory rack comprising:

a stationary enclosure;

a retractable member slidably carried on said stationary enclosure;

said retractable member having opposite ends with a selected end having an outwardly deployable article supporting means;

motor means operably connected between said stationary enclosure and said retractable member for advancing and retracting said retractable member out of and into said stationary enclosure; and said deployable article supporting means are pivotal arms adapted to pivot into an enclosure position within said stationary enclosure upon engagement with said stationary enclosure in response to retraction of said retractable member.

14. The rack defined in claim 13 including:

a power source mounted in said stationary housing;

a solar cell array carried on said selected end of said retractable member adjacent to said pivotal arms; and an extendable wiring circuit coupled between said power source and said solar cell.

* * * * *